US010626565B2

(12) United States Patent
Webb et al.

(10) Patent No.: US 10,626,565 B2
(45) Date of Patent: Apr. 21, 2020

(54) ROAD MARKER PLACEMENT APPARATUS

(71) Applicant: WJ North Limited, Newcastle under Lyme, Staffordshire (GB)

(72) Inventors: Martin Graham Webb, Biddulph Moor (GB); Mark Fawcett, Huddersfield (GB)

(73) Assignee: WJ NORTH LIMITED, Staffordshire (GB)

( * ) Notice: Subject to any disclaimer, the term of this patent is extended or adjusted under 35 U.S.C. 154(b) by 0 days.

(21) Appl. No.: 16/121,177

(22) Filed: Sep. 4, 2018

(65) Prior Publication Data

US 2020/0071893 A1 Mar. 5, 2020

(51) Int. Cl.

| | |
|---|---|
| ***E01C 23/00*** | (2006.01) |
| ***E01C 23/18*** | (2006.01) |
| ***E01F 9/512*** | (2016.01) |
| *E01F 9/553* | (2016.01) |

(52) U.S. Cl.

CPC ..... *E01C 23/18* (2013.01); *E01F 9/512* (2016.02); *E01F 9/553* (2016.02)

(58) Field of Classification Search

CPC ..... E01C 23/18; E01F 9/512; E01F 9/553
USPC ..... 404/12–14, 72–75, 93, 94, 111
See application file for complete search history.

(56) References Cited

U.S. PATENT DOCUMENTS

| | | | | |
|---|---|---|---|---|
| 3,864,052 | A | 2/1975 | Blomberg | |
| 4,322,177 | A * | 3/1982 | Eigenmann | E01C 23/18 404/83 |
| 5,244,334 | A | 9/1993 | Akita et al. | |
| 5,934,822 | A * | 8/1999 | Green | E01C 23/18 404/94 |
| 2009/0208287 | A1 * | 8/2009 | Rouse | E01C 23/166 404/75 |
| 2013/0105078 | A1 | 5/2013 | Dawson et al. | |

FOREIGN PATENT DOCUMENTS

| | | | |
|---|---|---|---|
| DE | 3526711 | A1 | 5/1987 |
| GB | 2548219 | A | 9/2017 |
| IE | 3018693 | A1 | 11/1981 |

* cited by examiner

*Primary Examiner* — Raymond W Addie
(74) *Attorney, Agent, or Firm* — PatentTM.US; James Walters

(57) ABSTRACT

A road marker placement apparatus has a dispenser for dispensing a road marker, a carriage for carrying the road marker dispensed by the dispenser, and a drive arrangement for driving the carriage from a collecting position. At the collecting position, the carriage can collect the road marker from the dispenser. The carriage can place the road marker on the road while being driven by the drive arrangement.

19 Claims, 13 Drawing Sheets

ROAD MARKER PLACEMENT APPARATUS

FIELD OF THE INVENTION

This invention relates to road marker placement apparatus. More particularly, but not exclusively, this invention relates to road marker placement apparatus for placing temporary road markers on roads. Embodiments of the invention relate to road marker placement apparatus for placing road studs, such as temporary road studs, on roads.

BACKGROUND

During road maintenance on major roads, such as dual carriageways and motorways, it is necessary to place temporary road markers to guide the traffic. At present, the road markers are placed by first depositing discrete portions of an adhesive along a line on a road. A worker on a seat mounted on the rear of a vehicle is then driven along the line to place the road markers manually into the adhesive.

SUMMARY OF THE INVENTION

According to one aspect of this invention, there is provided a road marker placement apparatus comprising a dispenser for dispensing a road marker, a carriage for carrying the road marker dispensed by the dispenser and a drive arrangement for driving the carriage from a collecting position, at which the carriage can collect the road marker from the dispenser, so that the carriage can place the road marker on the road while being driven by the drive arrangement.

According to another aspect of this invention, there is provided a road marker placement apparatus mountable on a vehicle movable in a first direction, the road marker placement apparatus comprising a dispenser for dispensing a road marker, a carriage for carrying road marker dispensed by the dispenser, and a drive arrangement for driving the carriage from a collecting position, at which the carriage can collect the road marker from the dispenser, so that the carriage can place the road marker on the road while the carriage is driven by the drive arrangement in a second direction opposite to the first direction of movement of the vehicle.

According to another aspect of this invention, there is provided a method of placing a road marker on a road, wherein the method comprises dispensing a road marker from a dispenser, providing a carriage, collecting the road marker with the carriage from the dispenser at a collecting position of the carriage, driving the carriage from the collecting position to a placing position of the carriage, and placing the road marker on the road while the carriage is being driven.

According to another aspect of this invention, there is provided a method of placing a road marker on a road from a road marker placement apparatus mounted on a vehicle, wherein the method comprises moving the vehicle along the road in a first direction, dispensing a road marker from a dispenser, providing a carriage, collecting the road marker with the carriage from the dispenser at a collecting position of the carriage, driving the carriage from the collecting position to a placing position of the carriage, wherein the carriage is drive in a second direction opposite to the first direction and placing the road marker on the road while the carriage is being driven by the drive arrangement in the second direction.

The first direction may be a forwards direction. The second direction may be a rearwards direction.

The method may further include driving the carriage from the placing position to the collecting position to collect a further road marker from the dispenser.

The drive arrangement may include a guide member along which the carriage can be driven by the drive arrangement. The guide member may be elongate.

The method may comprise driving the carriage along the guide member from the collecting position to the placing position. The method may comprise driving the carriage along the guide member from the placing position to the collecting position to collect the further road marker.

The dispenser may comprise a container in which a plurality of the road markers can be contained. The container may be configured to contain the plurality of the road markers in a stacked condition of the road markers. The method may comprise arranging a plurality of the road markers in the container in the stacked condition.

The container may be disposed adjacent the guide member. The dispenser may comprise a plurality of the containers. The containers may be arranged adjacent one another along the guide member.

The dispenser may further include a delivery arrangement for delivering the road markers individually to the carriage. The delivery arrangement may comprise a delivery member, which may define a recess in which an individual road marker can be received.

The delivery member may be movable between a receiving position, in which the road marker can be received in the recess, and a delivery position in which the road marker can be delivered to the carriage.

The method may comprise moving the delivery member to the receiving position, whereby the road marker can be received in the recess, and thereafter moving the delivery member to the delivery position. The method may further comprise collecting the road marker, by means of the carriage, from the delivery member when the delivery member is in the delivery position.

The delivery member may be slidably movable between the receiving and the delivery positions. In one embodiment, the delivery member may comprise a slider.

The delivery arrangement may further include a force applying means for applying a force to the delivery member to move the delivery member between the receiving and delivery positions. The force applying means may be pneumatically or hydraulically operated, or may be operated by a motor.

Where the dispenser comprises a plurality of the containers, each of said containers may comprise a respective delivery arrangement.

The carriage may comprise a holding device for holding the road marker. The holding device may comprise a suction arrangement for applying suction to the road marker, thereby holding the road marker on the suction arrangement.

The suction arrangement may comprise at least one suction cup. Preferably, the suction arrangement comprises a pair of the suction cups, whereby each suction cup can apply suction to the road marker.

The carriage may further include a placement arrangement for placing the road marker on the road. The placement arrangement may be operable to move between a withdrawn condition and an extended placement condition.

The placement arrangement may comprise a movable member. The movable member may be movable between a withdrawn position and an extended placement position. The extended placement position may be below the withdrawn position.

The holding device may be provided on the movable member. When the movable member is in the extended placement position, the holding device can release the road marker to allow the road marker to be placed on the road.

The road marker placement apparatus may be mounted on a vehicle. The guide member may extend from the dispenser rearwards of the vehicle. The method may comprise moving the vehicle along the road in a forwards direction at a predetermined speed and driving the carriage along the guide member in rearwards direction of the vehicle. The rearwards direction may be a direction opposite to the forwards direction. The method may comprise placing the road marker on the road during movement of the guide member in said rearwards direction.

The speed at which the carriage is driven along the guide member may be equal to the speed of the vehicle, but in the opposite direction, i.e. the speed at which the road moves relative to the vehicle. Thus, by driving the carriage along the guide member in the opposite direction to the movement of the vehicle, but at the same speed as the speed of the vehicle, the carriage remains above the same spot on the road while the carriage is so moving.

A discrete amount of an adhesive can be disposed on the aforesaid spot on the road. The method may comprise moving the movable member from the withdrawn position to the extended placement position to place the road marker on the road. Thus, by moving the movable member to the extended placement position while the carriage is moving along the guide member as described in the immediately preceding paragraph, the road marker is placed on the adhesive. The method may further comprise releasing the road marker when the movable member is in the extended placement position, thereby placing the road marker on the road.

The placement arrangement may further include a fixed member, the movable member being connected to the fixed member. The movable member may be movable relative to the fixed member. The movable member may be slidably movable relative to the fixed member. The movable member may be vertically movable.

The carriage may comprise a support to which the fixed member is attached.

The placement arrangement may be a pneumatically operated placement arrangement. The placement arrangement may comprise a pneumatically operated piston and cylinder arrangement.

It will be appreciated that the placement arrangement may comprise any other suitable placement arrangement having a movable member, which may be driven by a motor or may be hydraulically or pneumatically driven.

The movable member may be capable of being telescopically withdrawn into the fixed member. The movable member may be capable of being telescopically extended from the fixed member. The fixed member may comprise a cylinder into which the movable member is received.

The carriage may further include a cooperating arrangement for cooperating with the drive arrangement. The cooperating arrangement may connect the carriage to the drive arrangement, thereby allowing the carriage to be moved by the drive arrangement from the collecting position to place the road marker.

The drive arrangement may comprise a drive belt. The cooperating arrangement may be attached to the belt. The drive arrangement may further comprise a prime mover for driving the belt. The cooperating arrangement may comprise a connecting member to connect the carriage to the drive belt.

The prime mover may comprise a motor or may be pneumatically of hydraulically operated. It will be appreciated that the drive arrangement may comprise any other suitable drive means, such as a rodless cylinder.

The method may comprise moving the drive belt to move the carriage from the collecting position to the placing position. The method may comprise moving the drive belt to move the carriage from the placing position to the collecting position to collect the further road marker.

The road marker placement apparatus may comprise a speed measuring arrangement to measure the speed of the vehicle. The speed measuring arrangement may comprise a road engaging wheel to engage the road, whereby the speed of rotation of the wheel allows the speed of the vehicle to be measured.

The road marker placement apparatus may comprise a control arrangement for controlling the operation of the dispenser, of the carriage and of the drive arrangement. The control arrangement may comprise a data processing arrangement, such as a computer.

The control arrangement may be configured to effect coordination of the dispensing of the road marker from the dispenser, with the movement of the carriage by the drive arrangement to effect placement of a plurality of the road markers in a plurality of desired positions on the road.

The control arrangement may be configured to control operation of the placement arrangement to control movement of the movable member between the withdrawn and extended placement positions thereof.

Said control of the placement arrangement may coordinate operation of the placement arrangement with operation of the dispenser with movement of the carriage to effect the aforesaid placement of a plurality of the road markers in a plurality of desired positions on the road.

The speed measuring arrangement may be connected to the control arrangement, whereby information relating to the speed of the vehicle may be processed to control the movement of the dispenser, of the carriage and of the drive arrangement. The information relating to the speed of the vehicle may be processed to control the operation of the placement arrangement.

According to another aspect of the invention, there is provided a road marking assembly comprising a road marker placement apparatus as described above and a mounting arrangement to mount the road marker placement apparatus on a vehicle.

The mounting arrangement may comprise a mounting frame arrangement.

The mounting arrangement may comprise a fixed mounting, which may be mountable on the vehicle. The mounting arrangement may comprise a positioning arrangement for positioning the road marker placement apparatus in a desired position relative to the fixed mounting. The road marker placement apparatus may be attached to the positioning arrangement.

The positioning arrangement may be configurable to move the road marker placement apparatus to a desired position relative to the road. The positioning arrangement may be configured to move between a stowed condition and a working condition. The positioning arrangement may be configured to move the road marker placement apparatus vertically and horizontally relative to the main assembly.

The fixed mounting arrangement may comprise a fixed mounting frame. The method may comprise moving the positioning arrangement to move the road marker placement apparatus to a desired position relative to the road.

The positioning arrangement may comprise a vertical displacement mounting for effecting vertical movement of the road marker placement apparatus. The vertical displacement mounting may be movably mounted on the fixed mounting.

The vertical displacement mounting may be movable relative to the fixed mounting between a lowered operating position and a raised position. The vertical displacement mounting may be movable vertically between the lowered operating position and the raised position. The vertical displacement mounting may comprise a vertical displacement frame. The method may comprise moving the vertical displacement mounting to move the road marker placement apparatus in a vertical direction.

The positioning arrangement may include a horizontal displacement mounting for effecting horizontal movement of the road marker placement apparatus. The horizontal displacement mounting may be movable horizontally between a retracted position and a projecting operating position. The positioning arrangement may be movable horizontally relative to the vertical displacement mounting. The road marker placement apparatus may be attached to the horizontal displacement mounting.

The method may comprise moving the horizontal displacement mounting to move the road marker placement apparatus in a horizontal direction.

In one embodiment, the vertical displacement mounting may be mounted on the fixed mounting. In this embodiment, the horizontal displacement mounting may be mounted on the vertical displacement mounting.

In one embodiment, the speed measuring arrangement may be provided on the positioning arrangement. In this embodiment, the speed measuring arrangement may be mounted on the vertical displacement mounting.

The road marker may comprise a road stud. The road stud may comprise a temporary road stud. Each of the road markers may be a road stud. Each of the road studs may be a temporary road stud.

BRIEF DESCRIPTION OF THE DRAWINGS

An embodiment of the invention will now be described by way of example only, with reference to the accompanying drawings.

DETAILED DESCRIPTION

Figure 1:
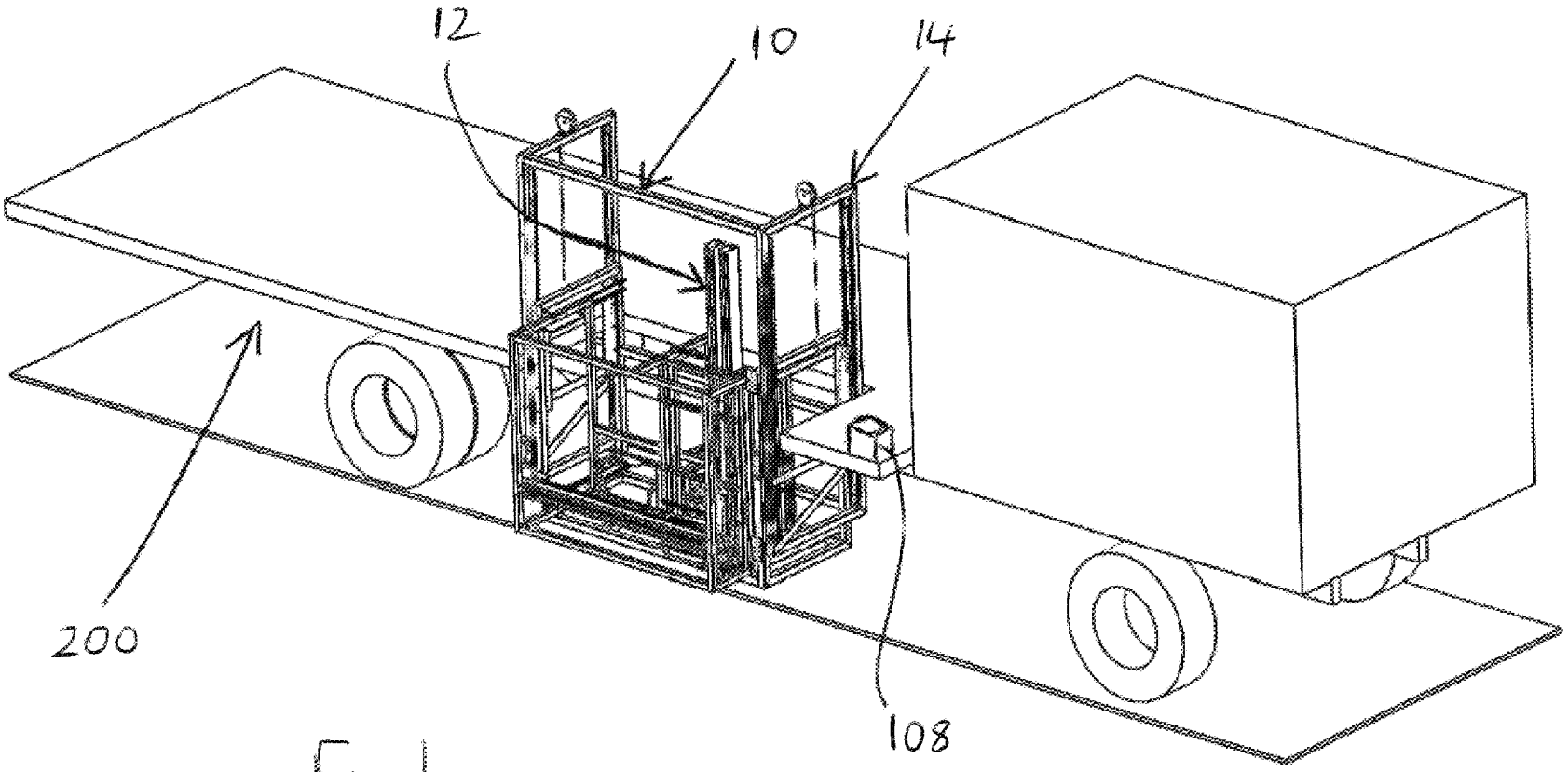
FIG. 1 is a schematic perspective view of a vehicle incorporating a road marking assembly.

FIG. 1 shows a road marking assembly 10 on a vehicle 200. The road marking assembly 10 comprises a road marker placement apparatus 12 (shown more clearly in the other drawings) and a mounting arrangement 14 for mounting the road marker placement apparatus 12 on the vehicle 200. The road marker placement apparatus 12 is used to place temporary road markers 15 onto a road.

Figure 2:
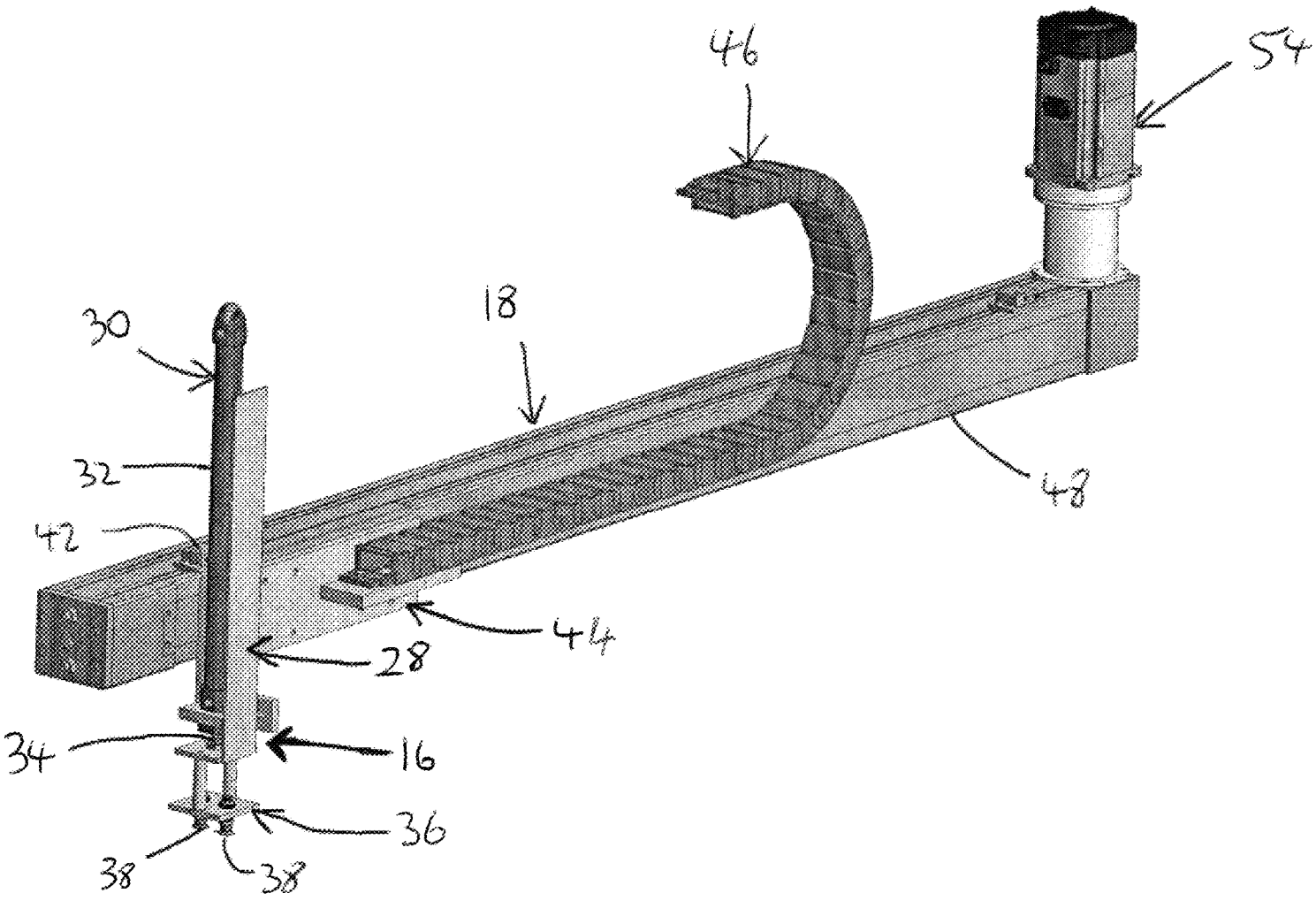
FIG. 2 is a perspective view of a carriage and a drive arrangement forming part of a road marker placement apparatus.
Figure 4:
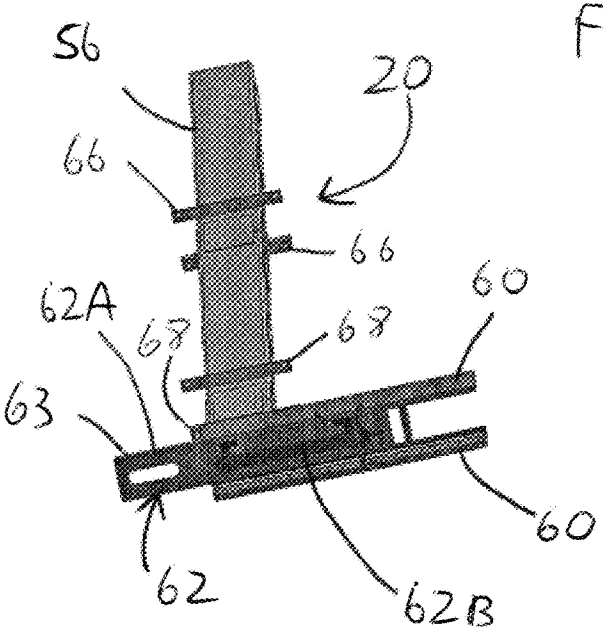
FIG. 4 is a perspective view from below of the delivery arrangement.
Figure 3:
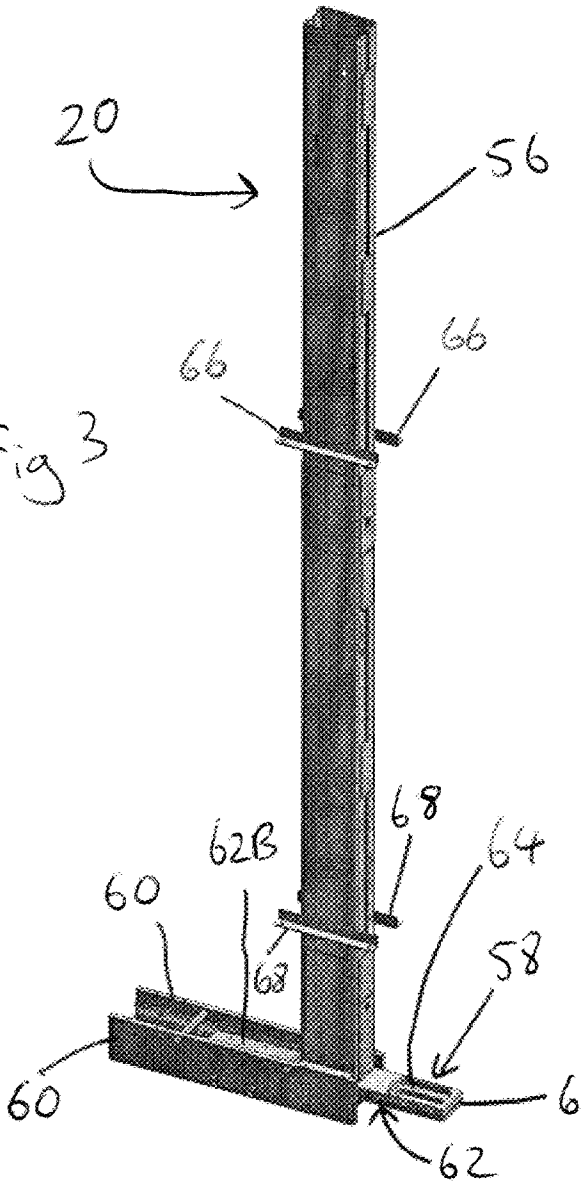
FIG. 3 is a perspective view from above of a delivery arrangement forming part of the road marker placement apparatus.

FIGS. 2, 3 and 4 show components of the road marker placement apparatus 12. FIG. 2 shows a carriage 16 and a drive arrangement 18. The drive arrangement 18 is attached to an elongate attaching member 22 (see FIGS. 7 and 8) which, in turn, is attached to the mounting arrangement 14.

FIGS. 3 and 4 show a dispenser 20. In the embodiment of the road marker placement apparatus 12 described herein, the road marker placement apparatus 12 comprises two of the dispensers 20 attached to upper and lower further elongate attaching members 24, 26 (see FIGS. 7 and 8). The upper and lower further elongate attaching members 24, 26 are attached to the mounting arrangement 14 adjacent the drive arrangement 18.

The carriage 16 comprises a support 28 to which a placement arrangement 30 is attached. The placement arrangement 30 is in the form a pneumatic piston and cylinder assembly comprising a fixed member in the form of a cylinder 32 and a movable member in the form of a piston 34 telescopically received within the cylinder 32.

The placement arrangement 30 is connected to a suitable pneumatic system for moving the piston 34, as would be understood by those skilled in the art. It will be appreciated that any other suitable placement arrangement can be used, for example one that is hydraulically operated, or one that is operated by means of an electric motor.

The piston 34 is movable between a withdrawn position shown in FIG. 2 and an extended placement position, in which the piston 34 extends downwardly from the cylinder 32

A holding device 36 is provided on the lower free end of the piston 34. The holding device 36 comprises a suction arrangement comprising a pair of suction heads 38 connected by suitable air lines 40 to a pump (not shown) for applying suction to the suction heads 38.

Figure 5:
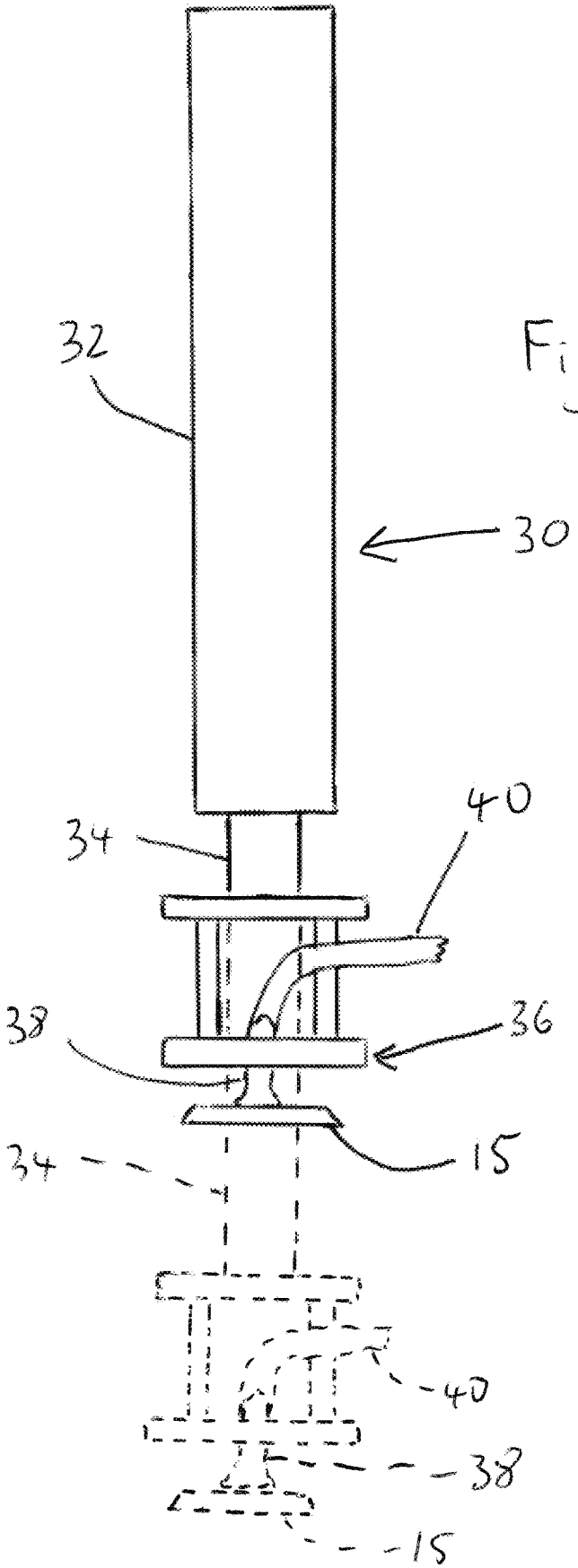
FIG. 5 is a diagrammatic view of a placement arrangement being part of the carriage.

FIG. 5 is a schematic side diagrammatic view of the placement arrangement 30. The piston 34 is shown in solid lines in the withdrawn position, and in broken lines in the extended placement position.

Referring back to FIG. 2, the carriage 16 is attached to the drive arrangement 18 by means of a connecting member 42 and an attaching plate 44. A flexible conduit 46 is mounted on the attaching plate 44. Pneumatic lines (not shown) extend through the conduit 46 to connect the placement arrangement 30 to the pneumatic system.

The attaching plate 44 is attached to the carriage 16. The connecting member 42 extends from the mounting plate to the drive arrangement 18.

Figure 6:
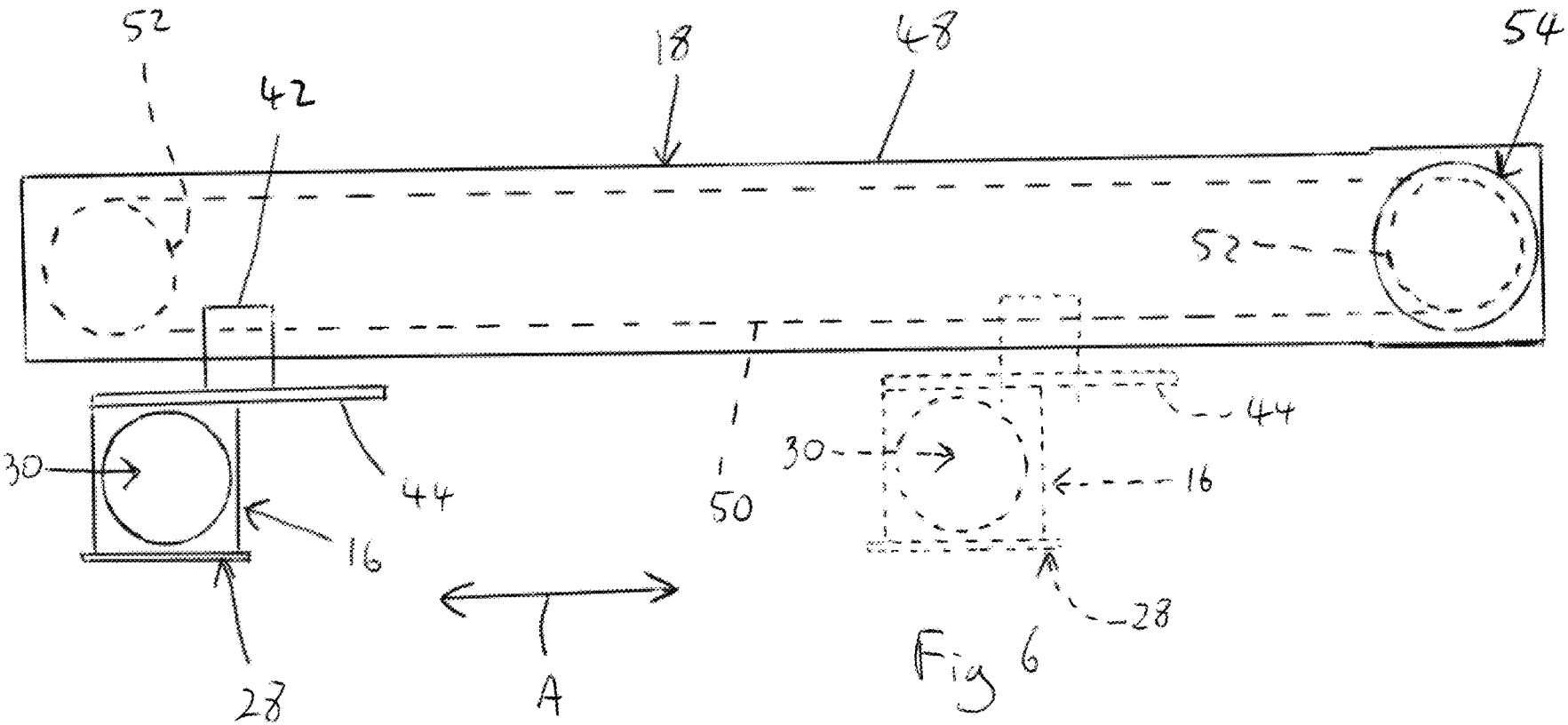
FIG. 6 is a diagrammatic view of the drive arrangement and the carriage.

FIG. 6 is a top plan schematic diagrammatic view of the drive arrangement 18 and the carriage 16. The drive arrangement 18 comprises an elongate guide member 48, in the form of a within which is housed an endless belt 50, shown in broken lines in FIG. 6. The belt 50 extends around sprockets 52 at opposite ends of the guide member 48. A prime mover in the form of a motor 54 is provided at one of the ends of the guide member 48. The motor 54 is connected to one of the sprockets 52 to rotate the sprocket 52 and, thereby, move the belt 50 in opposite directions.

The connecting member 42 is attached to the belt 50. Thus, movement of the belt 50 drives the carriage 16 in the opposite directions, as indicated by the double headed arrow A in FIG. 6. As a result, the carriage 16 can be moved backwards and forwards along the guide member 48 from a collecting position, shown in solid lines in FIG. 6, to a placing position, shown in broken lines in FIG. 6.

The placing position can be varied along the length of the guide member 48, depending upon the speed of the vehicle 200. Similarly, the collecting position can be varied along the guide member 48, depending upon whether the carriage 16 is intended to collect the road markings 15 from one or the other of the dispensers 20.

FIGS. 3 and 4 show one of the dispensers 20, which comprises an elongate container 56 in which a plurality of the road markers 15 are contained. The road markers 15 are disposed in the container 56 in a stacked condition one above the other. The dispensers 20 are disposed on the mounting arrangement 14 adjacent the guide member 48.

The dispenser 20 further includes a delivery arrangement 58 comprising a pair of opposed guide tracks 60 and a delivery member 62 slidably movable along the guide tracks 60. The delivery member 62 comprises a forward receiving portion 62A and a rearward stabilising portion 62B. The forward receiving portion 62A defines a recess 64 in which the lower most road marker 15 can be received, as explained below.

The delivery member 62 is in the form of a slider, slidably movable along the guide tracks 60 between a delivery position and a receiving position. The delivery member 62 may be moved by means of a suitable pneumatic driver. Other drivers, such as hydraulic or electrically operated can be used.

In the delivery position, as shown in FIGS. 3 and 4, the forward receiving portion 62A projects forwardly relative to the container 56.

The container 56 is disposed on the mounting arrangement 14 in a location so that, when the delivery member 62 is in the delivery position, the recess 64 is directly below the placement arrangement 30 when the carriage 18 is in the collecting position and is intended to collect the markers 15 from that dispenser 20. In the delivery position, the rearward stabilising portion 62B is disposed beneath the container 56, and is held by the guide tracks 60, thereby stabilising the delivery member 62 in the delivery position.

When the delivery member 62 is in the receiving position, the forward receiving portion 62A is disposed beneath the container 56 so that the lower most road marker 15 drops into the recess 64.

Figure 7:
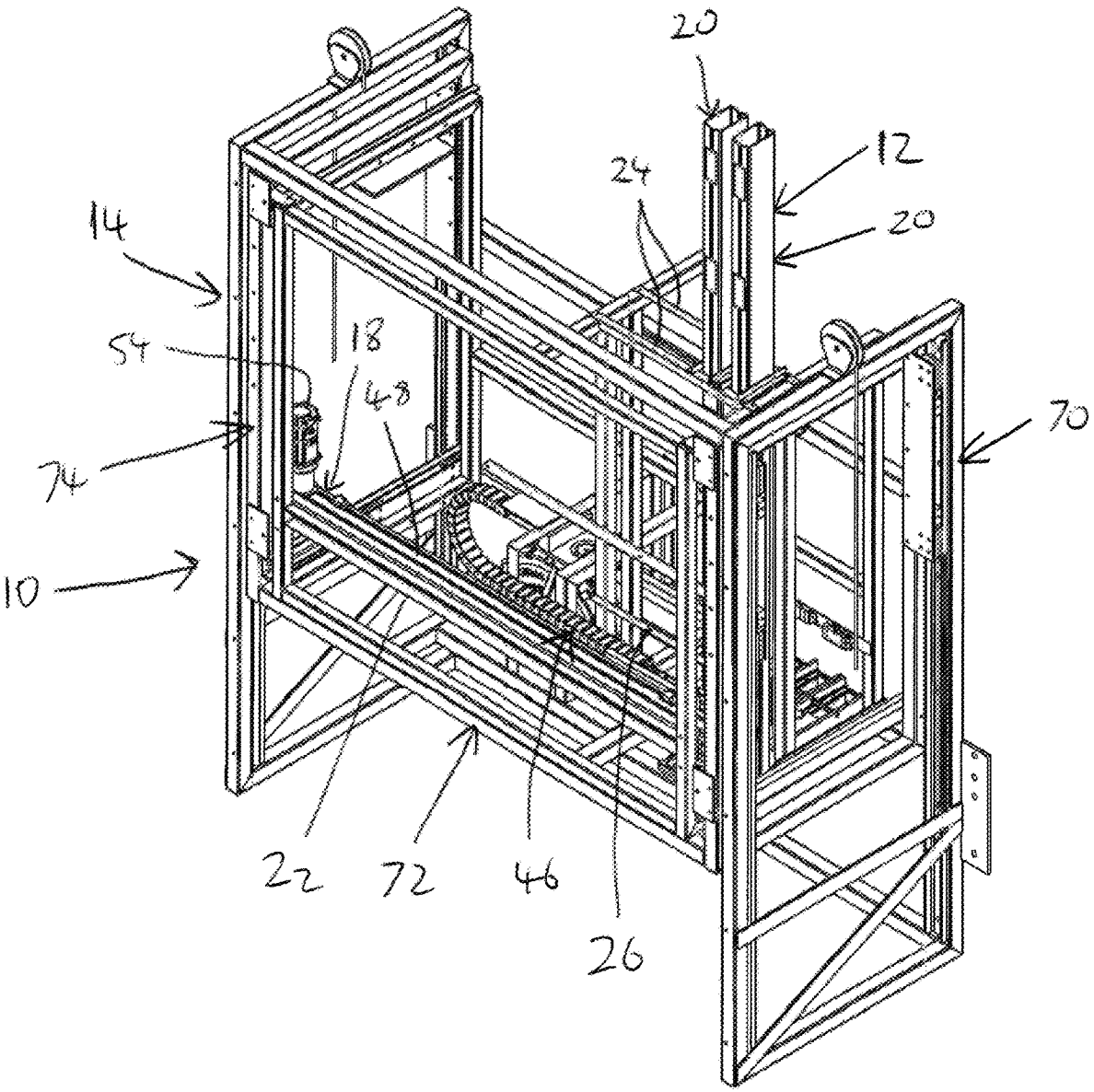
FIG. 7 is a front perspective view of the road marking assembly showing a mounting arrangement in a stowed condition.
Figure 8:
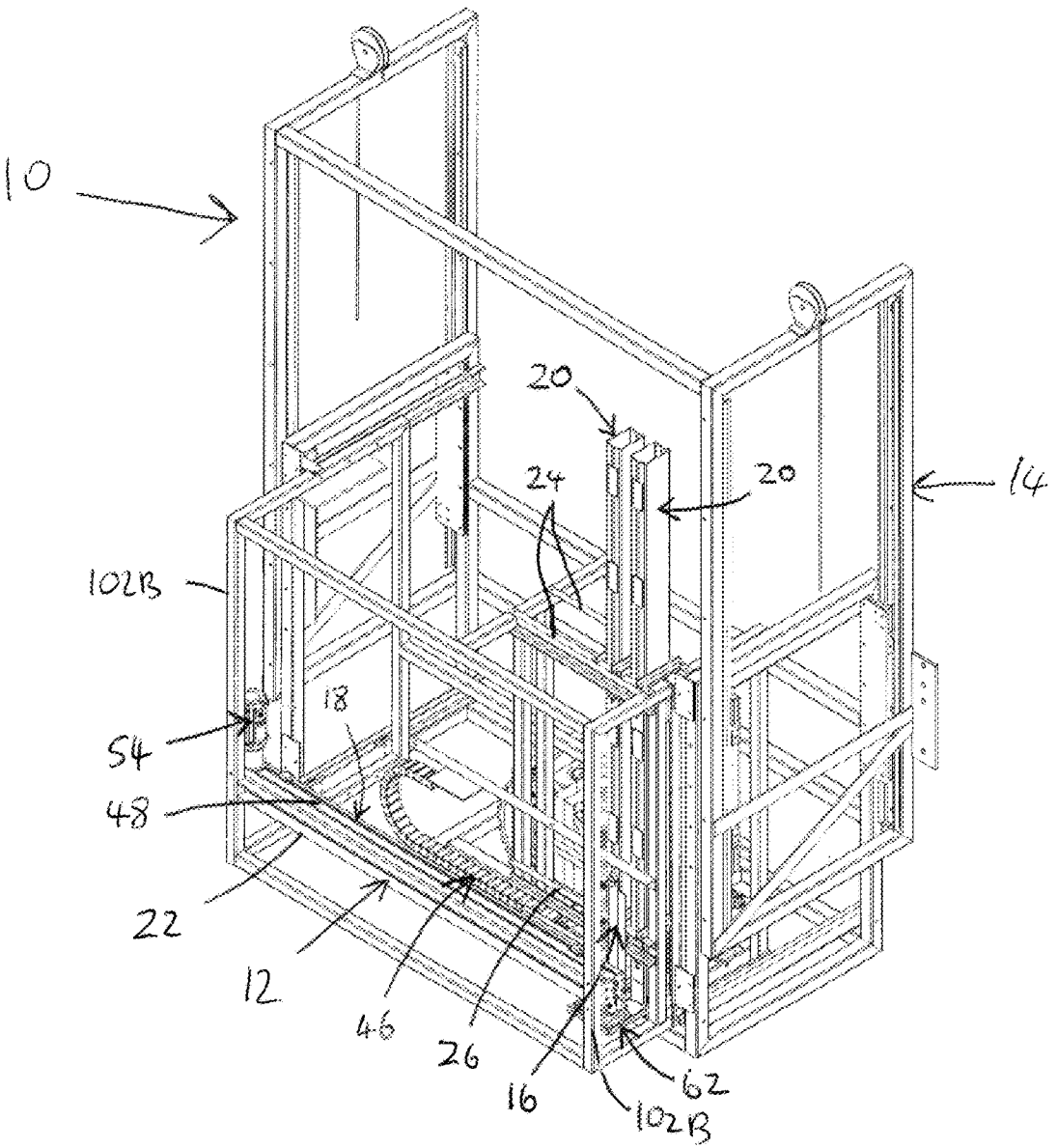
FIG. 8 is a front perspective view of the road marking assembly showing the mounting arrangement in a working condition.

The container 56 has upper and lower attaching elements 66, 68 to attach the dispenser 20 to the upper and lower elongate attaching members 24, 26 respectively (see FIGS. 7 and 8).

The road marking assembly 10 is shown in more detail in FIGS. 7 to 11. The road mounting arrangement 14 comprises a fixed mounting frame 70 and a positioning arrangement 72 movably mounted on the fixed mounting frame 70.

The positioning arrangement 72 comprises a vertical displacement frame 74 and a horizontal displacement frame 76. The vertical displacement frame 74 is mounted on the fixed mounting frame 70 for vertical movement relative thereto.

The horizontal displacement frame 76 is mounted on the vertical displacement frame 74. The horizontal displacement frame 76 is movable horizontally relative to the vertical displacement frame 74.

FIG. 7 shows the positioning arrangement 72 in a raised stowed condition, in which the vertical displacement frame 74 and the horizontal displacement frame 76 are raised and retracted into the fixed mounting frame 70.

FIG. 8 shows the positioning arrangement 72 in a lowered working condition, in which the positioning vertical displacement frame 74 and the horizontal displacement frame 76 project from, and are lowered relative to, the fixed mounting frame 70. In the lowered working condition, the road marker placement apparatus can be operated to place the road markers 15 on the road, as explained below.

Figure 9:
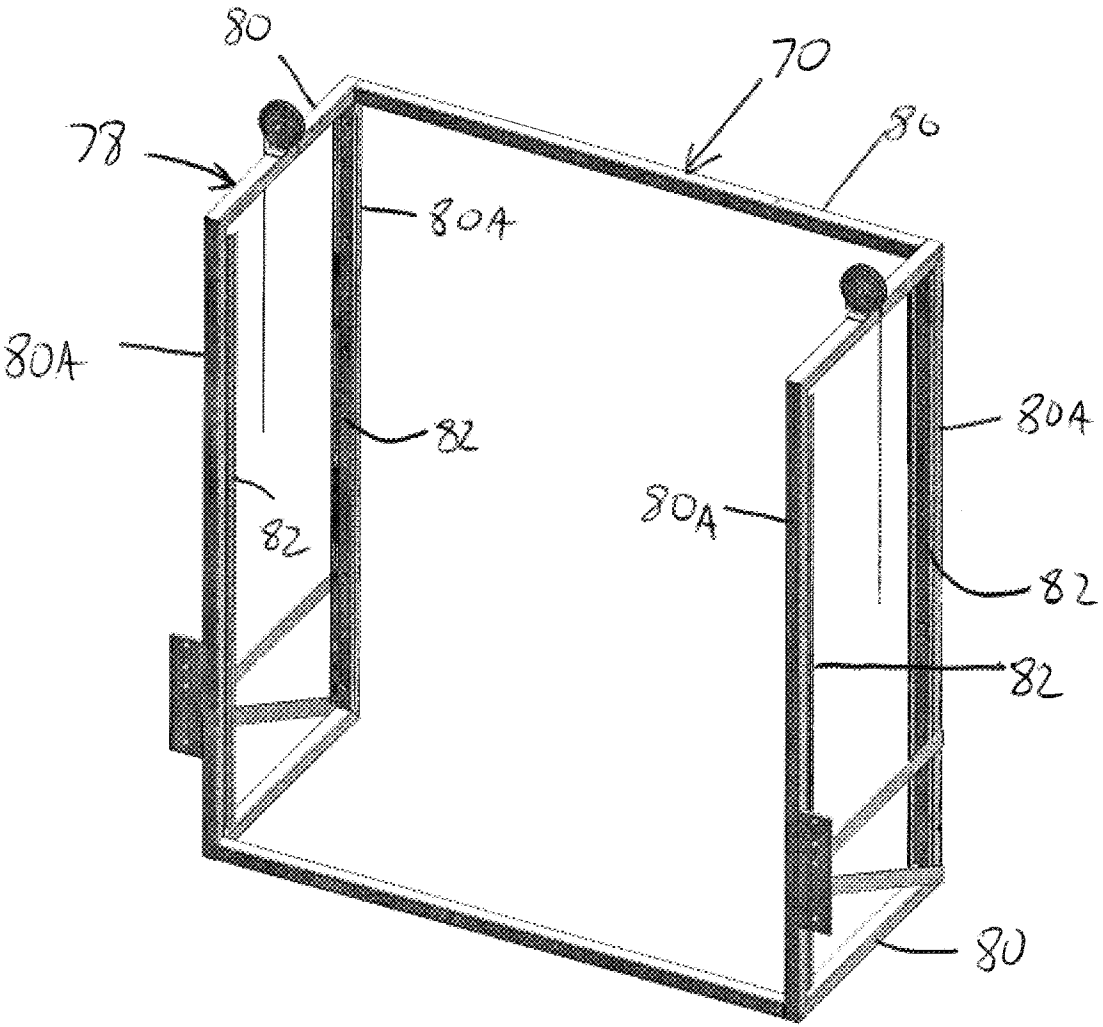
FIG. 9 is a rear perspective view of a fixed mounting being part of the mounting arrangement.

FIG. 9 is a rear view of the fixed mounting frame 70, which comprises a cuboid structure 78 formed of a plurality of elongate structural members 80. The plurality of elongate structural members 80 comprises two pairs of vertical struts 80A. The struts 80A of each pair has attached thereto opposed elongate vertically extending tracks 82 in which rollers 84 (see FIG. 10) on the vertical displacement frame 74 can be received. The rollers 84 can move up and down the vertical tracks 82, thereby enabling vertical movement of the vertical displacement frame 74.

The fixed mounting frame 70 includes securing plates 86 to secure the fixed mounting frame 70 to the vehicle 200.

Figure 10:
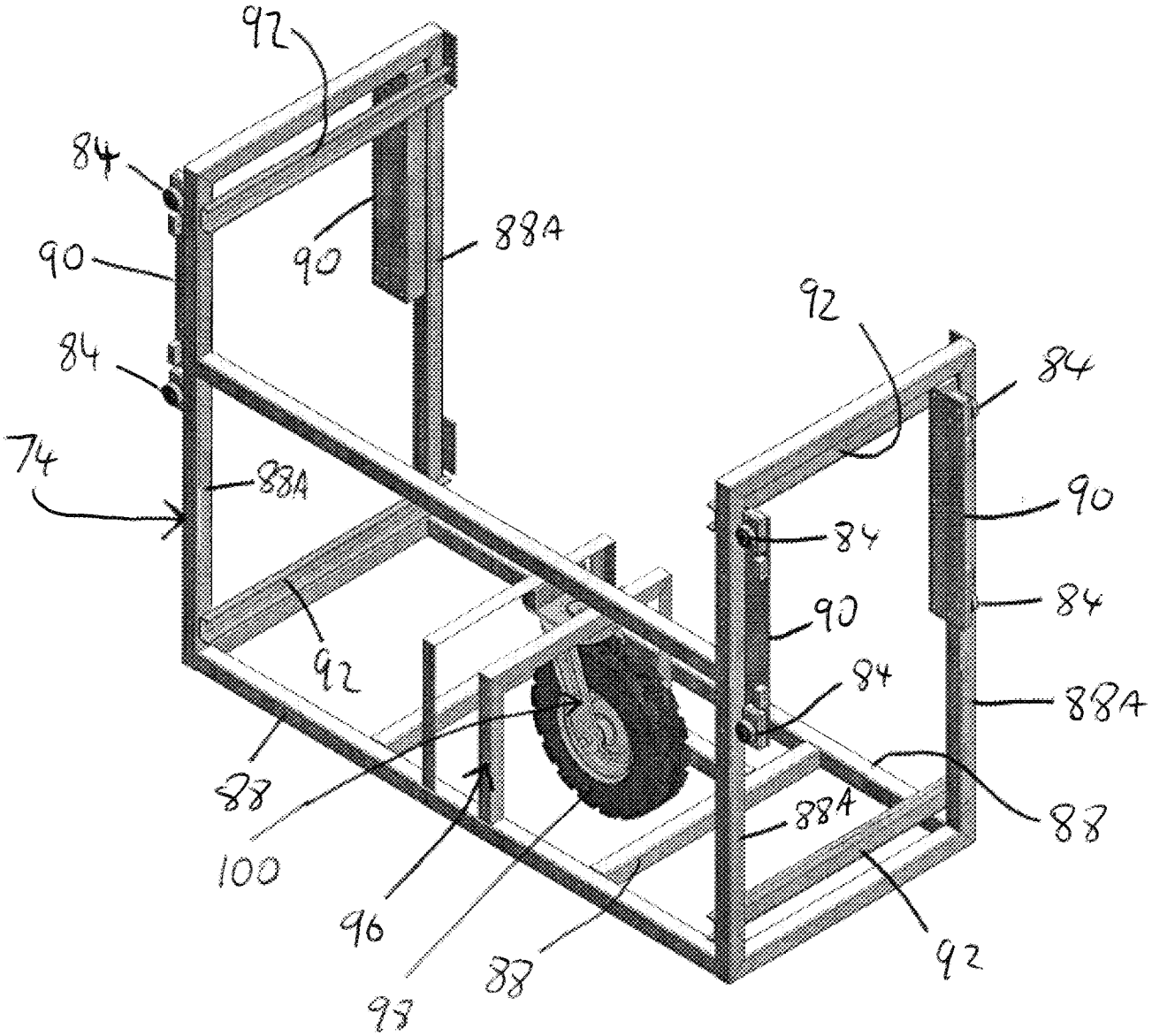
FIG. 10 is a rear perspective view of a vertical displacement mounting.

FIG. 10 is a rear view of the vertical displacement frame 74 which is also in the form of a cuboid structure and is formed of a plurality of further elongate structural members 88. The plurality of the further elongate structural members 88 comprises two pairs of vertical struts 88A, on which are provided the rollers 84. Each vertical strut 88A has attached thereto a respective roller supporting member 90. A respective pair of the rollers 84 are rotatably attached to each roller supporting member 90.

The vertical displacement frame 74 is received in the fixed mounting frame 70, between the two pairs of struts 80A. As explained above, the rollers 84 are received in the tracks 82 so that the vertical displacement frame 74 can move vertically relative to the fixed mounting frame 70.

The vertical displacement frame 74 also includes upper and lower elongate horizontally extending tracks 92 secured between the vertical struts 88A of each pair of vertical struts 88A. Further rollers 94 of the of the horizontal displacement frame 76 can be received in the horizontally extending tracks 92. The further rollers 94 can move along the horizontally extending tracks 92, thereby enabling horizontal movement of the horizontal displacement frame 76 relative to the vertical displacement frame 74.

The vertical displacement frame 74 further includes a bridging arrangement 96 extending between two opposite lower struts 88. The bridging arrangement 96 has a speed measuring arrangement thereon. The speed measuring arrangement comprises a wheel 98 and a fork arrangement 100 in which the wheel 98 is rotatably mounted. The fork arrangement 100 connects the wheel 98 to the bridging arrangement 96.

The wheel 98 is oriented in the same direction as the vehicle wheels and measure the speed of the vehicle 200 when the road markers 15 are being placed on the road.

Figure 11:
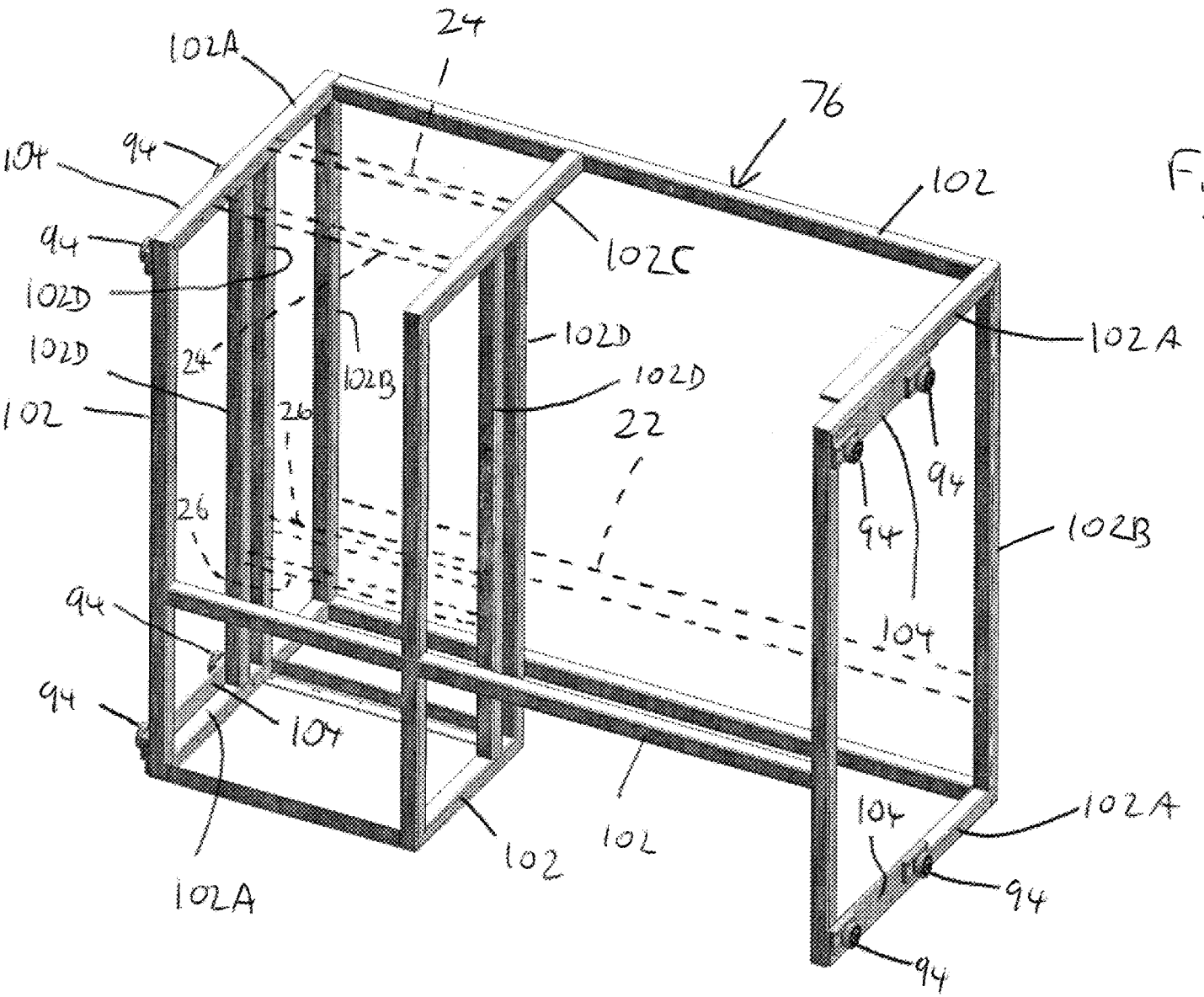
FIG. 11 is a rear perspective view of a horizontal displacement mounting.

FIG. 11 is a rear view of the horizontal displacement frame 76, which is received within the vertical displacement frame 74. The horizontal displacement frame 76 has a cuboid configuration and is formed of a plurality of additional elongate structural members 102.

The plurality of the additional structural members 102 includes two pairs of upper and lower end horizontal structural members 102A. The further rollers 94 are rotatably mounted on the end horizontal structural members 102A by means of roller supporting members 104. A respective roller supporting member 104 is attached to each of the end horizontal structural members 102A, and a pair of the further rollers 94 are rotatably attached to each roller supporting member.

The further rollers 94 are received in the horizontally extending tracks 92 of the vertical displacement frame 74 to allow horizontal movement of the horizontal displacement frame 76.

The road marker placement apparatus 12 is attached to the horizontal displacement frame 76. The plurality of the additional structural members 102 includes a pair of forward vertical structural members 1028. The drive arrangement 18 is attached to the elongate attaching member 22 (shown in broken lines in FIG. 11). The elongate attaching member 22 is provided between the forward vertical support members 102B.

The plurality of the additional structural members 102 includes a central upper horizontal additional structural member 102C. The upper further elongate attaching members 24 (shown in broken lines in FIG. 11) are provided between the central upper structural member 102C and the adjacent end upper structural member 102A.

The plurality of additional structural members 102 also includes central structural members 102D and side structural members 102E. The lower further elongate attaching members 26 extend between the central structural members 102D and the side structural members 102E.

The vertical displacement frame 74 is vertically movable on the fixed mounting frame 70 between a raised position, shown in FIG. 7, and a lowered operating position, shown in FIG. 8. The horizontal displacement frame 76 is horizontally movable on the vertical displacement frame 74 between a retracted position, shown in FIG. 7, and a projecting operating position, shown in FIG. 8.

When the vertical displacement frame 74 is in the lowered operating position and the horizontal displacement frame 76 is in the projecting operating position, the wheel 98 engages the road, and the placement arrangement 30 is in a position in which it can place the road markers 15 on the road.

FIGS. 12A to 12H show schematically the steps in the operation of the road marker placement apparatus 10. The embodiment shown in FIGS. 12A to 12H is slightly different from the embodiment shown in FIGS. 2 to 6, in that the dispenser 20 is provided at one end of the guide member 48, instead of to one side of the guide member 48. However, the operation of the embodiment shown in FIGS. 2 to 6 will be readily understood by the skilled person from the description below.

In FIGS. 12A to 12H the road marker placement apparatus 10 is mounted on a vehicle 200, but the vehicle 200 is not shown for reasons of clarity. The vehicle 200 is travelling along a road 105 in the direction indicated by the arrow V at a predetermined speed.

A plurality of discrete portions 106 of the adhesive material, such as molten asphalt are disposed on the road at a predetermined distance from one another.

Figure 12A:
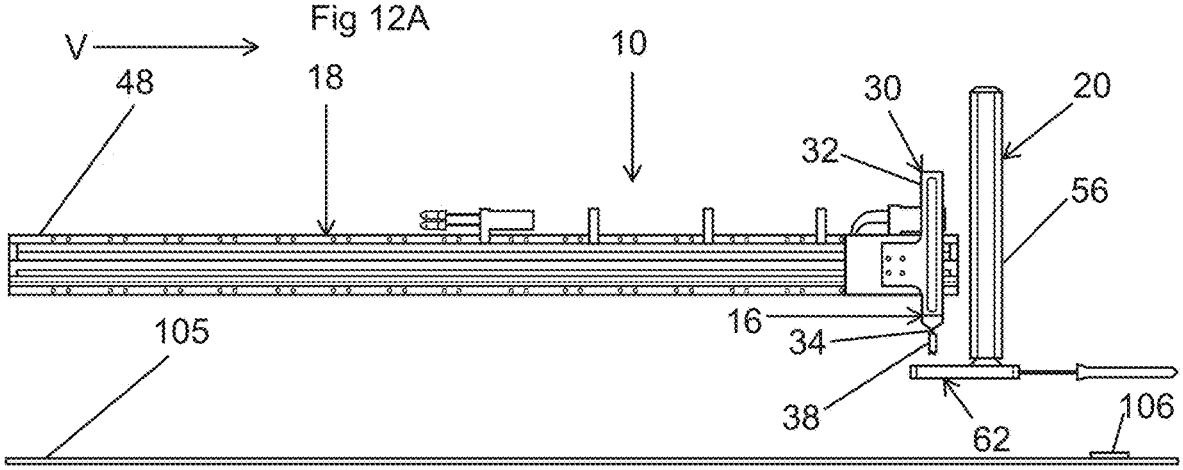
FIGS. 12A to 12H show schematically the steps in the operation of the road marker placement apparatus.

In FIG. 12A, the delivery member 62 is holding one of the road markers 15 in its recess 64. The carriage 16 is in the collecting position, and the delivery member 62 is in its delivery position directly under the placement arrangement 30.

Figure 12B:
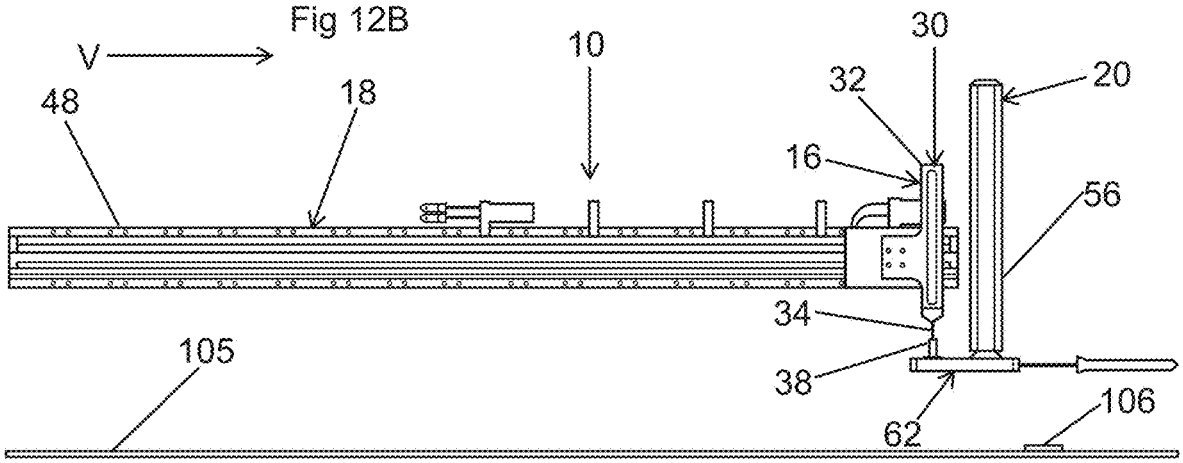

In FIG. 12B, the piston 34 is extended from the cylinder 32 and moves downwardly so that the suction head 38 engages the road marker 15 in the recess 64. Suction is then applied so that the suction head 38 picks up the road marker 15.

Figure 12C:
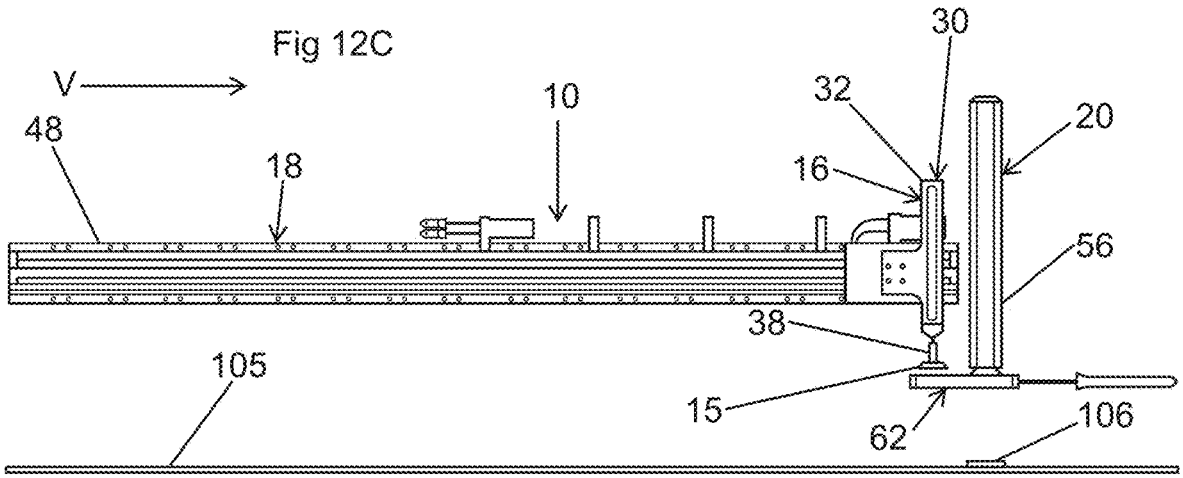

The piston 34 is withdrawn into the cylinder 32, as shown in FIG. 12C. The suction head 38 lifts the road marker 15 from the delivery member 62. At this point, the placement arrangement 30 is static relative to the guide member 48, but is travelling along with the vehicle 200 in the direction indicated by the arrow V.

The placement arrangement 30 is almost directly over the portion 106 of the adhesive. The drive arrangement 18 begins to move the placement arrangement 30 along the guide member 48 in the direction of the arrow P. The drive arrangement 18 accelerates the placement arrangement 30 to the same speed as the vehicle 200 but in the opposite direction.

Figure 12D:
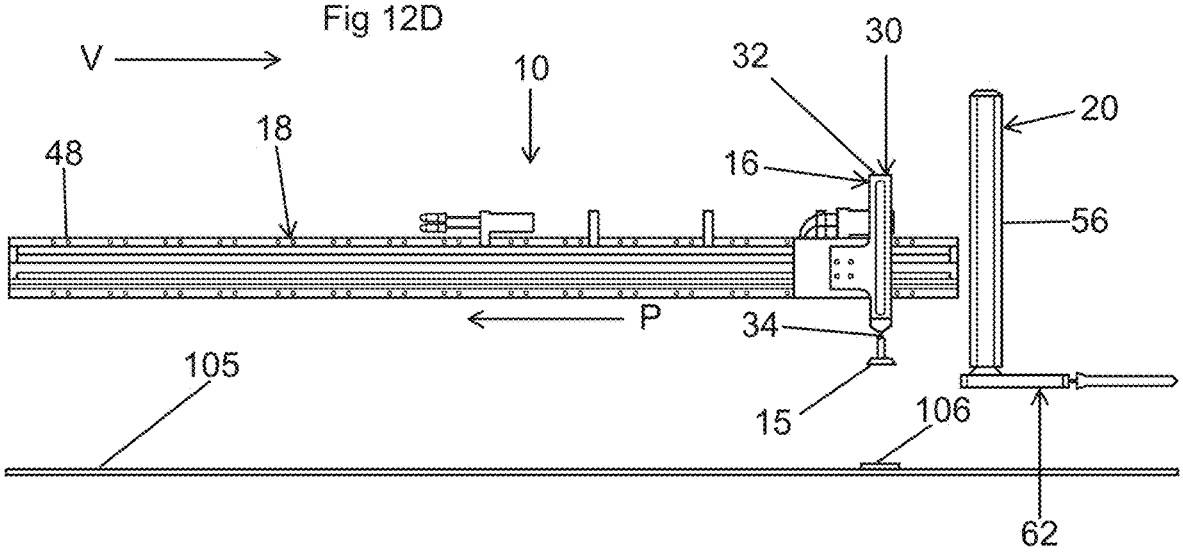
Figure 12E:
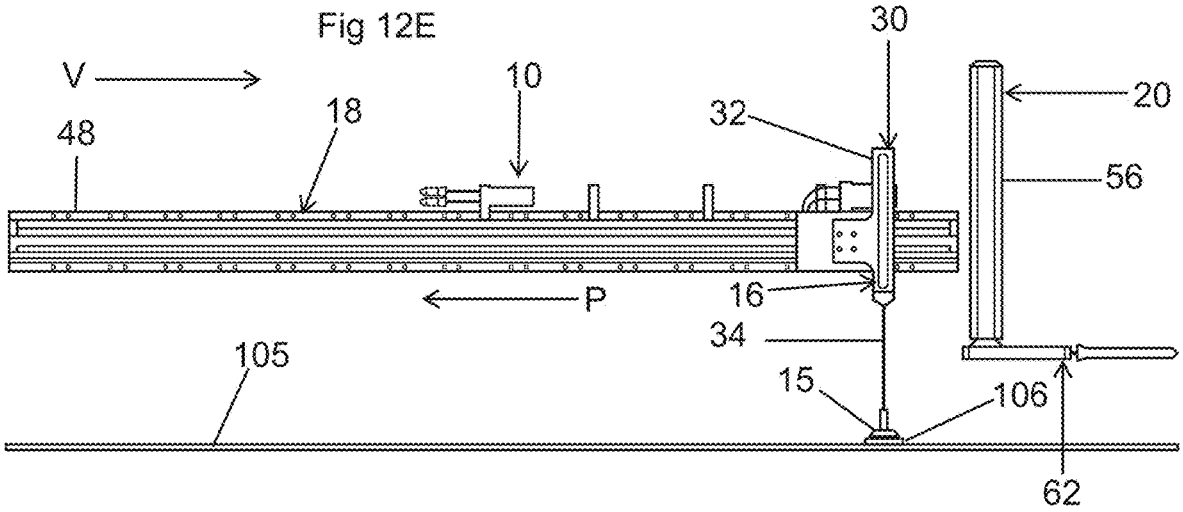
Figure 12F:
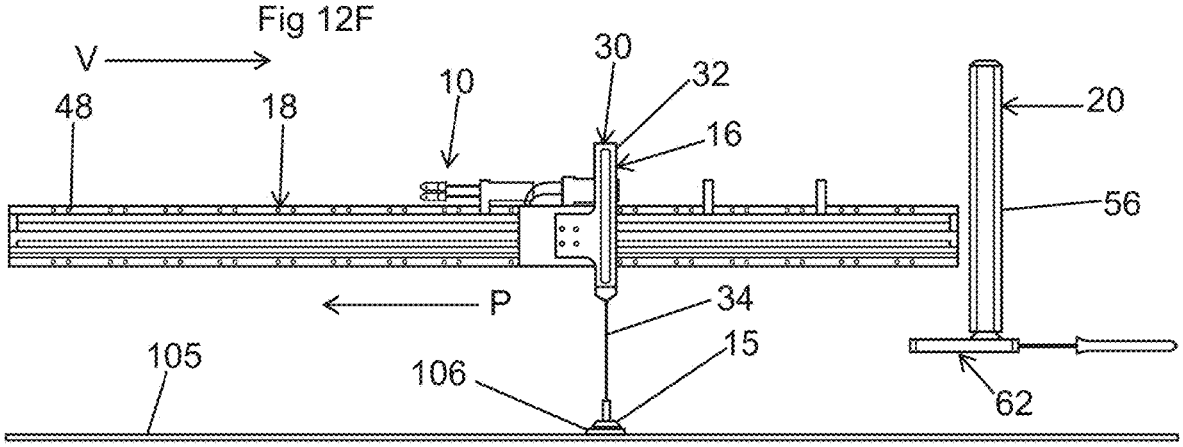

As the vehicle 200 moves the placement arrangement 30 to the position over the portion 106 of the adhesive, the drive arrangement 30 is accelerated to the speed of the vehicle 200. Because the placement arrangement 30 is moving in the opposite direction to that of the vehicle 200, the effect is that the placement arrangement 30 remains stationary over the portion 106 of the adhesive, as shown in FIGS. 12D to 12F. At the stage shown in FIG. 12D, the delivery member 62 is moved to its receiving position so that a further road marker 15 can be received in the recess 64 in the delivery member 62.

The piston 34 is moved downwardly to the placement position, as shown in FIG. 12E, at which the road marker 15 is pressed into the portion 106 of the adhesive. FIG. 12F shows the piston 34 maintained in the placement position while the carriage 16 moves further along the guide member 48, thereby pushing the road marker 15 into the adhesive.

Figure 12G:
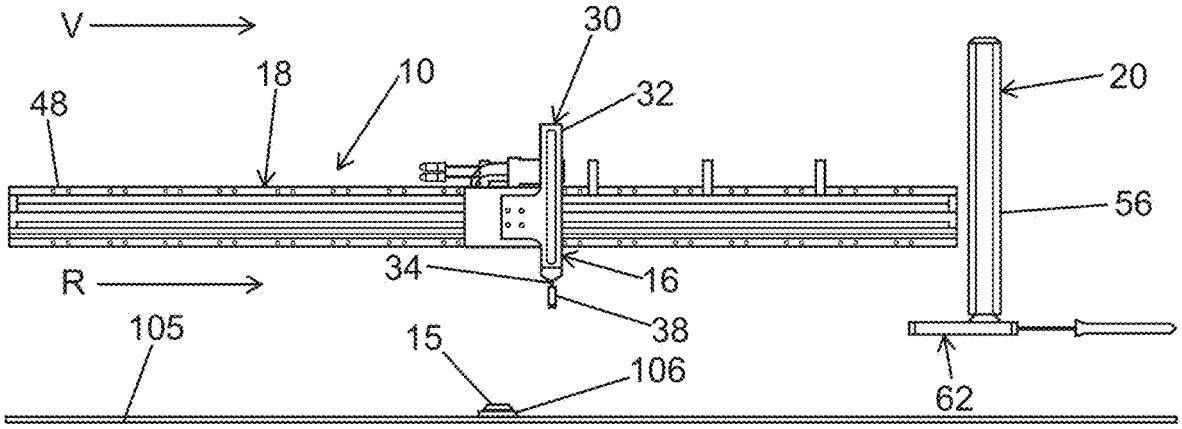

FIG. 12G shows the piston 34 subsequently moved to the withdrawn position, and the carriage 16 returning to the collecting position in the direction indicated by the arrow R. At this stage, the delivery member 62 is moved to its delivery position.

Figure 12H:
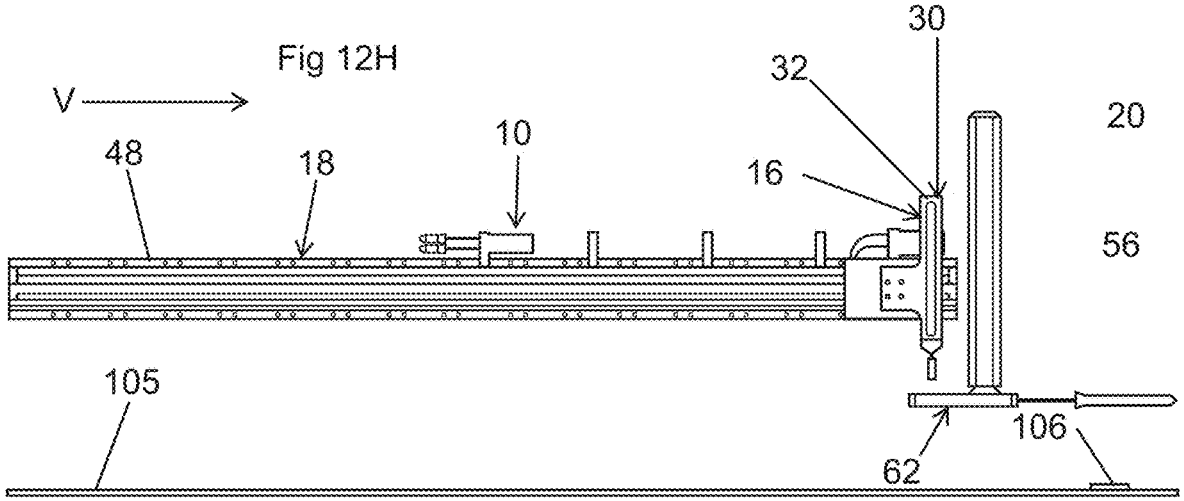

FIG. 12H, shows the next stage, which is the same as the stage shown in FIG. 12A. The carriage 16 is at the collecting position above the delivery member 62 in its delivery position. FIG. 12H also shows the carriage about to move over the next portion 106. Thus, the above described procedure is repeated for each of the portions 106 of the adhesive.

The road marking assembly 10 further includes a control arrangement 108 for controlling the road marker placement apparatus 12 and the mounting arrangement 14.

The wheel 98 is provided with a speed sensor which is connected, either wirelessly or by the use of cables, to the control arrangement 108. The speed sensor measures the speed of rotation of the wheel 98 and thereby measures the speed of the vehicle 200. Information relating to the speed of the vehicle is sent from the speed sensor to the control arrangement 108. The control arrangement 108 controls the operation and movement of the carriage 16, the drive arrangement 18, the placement arrangement 30, and the delivery member 62.

The control arrangement 108 processes the information received from the speed sensor to coordinate the speed of the vehicle with the movement of the carriage 16, the drive arrangement 18, the placement arrangement 30, and the delivery member 62. The control arrangement 108 moves the placement arrangement 30 so that remains directly above the portion 106 of the adhesive on the road 105 while the piston 34 places the road marker 15 thereon for each road marker 15 placed on the road 105.

There is thus described a road marking assembly 10 and a road marker placement apparatus 12 for placing road markers 15 on a road 105 which obviates the need for the road markers 15 to be placed on the road by hand.

Various modifications can be made without departing from the scope of the invention.

The invention claimed is:

1. A road marker placement apparatus comprising: a dispenser for dispensing a road marker: a carriage for carrying the road marker dispensed by the dispenser; an elongate guide member; and a drive arrangement to drive the carriage along the guide member from a collecting position at which the carriage can collect the road marker from the dispenser; wherein the carriage includes: a placement arrangement for placing the road marker on the road, the placement arrangement comprising a movable member which can be moved between a withdrawn position and an extended placement position; and a holding device for holding the road marker, the holding device being provided on the movable member, whereby when the movable member is in the extended placement position, the holding device can release the road marker and place the road marker on the road while the carriage is driven by the drive arrangement.

2. A road marker placement apparatus according to claim 1, wherein the holding device comprises a suction arrangement for applying suction to the road marker, thereby holding the road marker on the suction arrangement.

3. A road marker placement apparatus according to claim 1, wherein the placement arrangement further includes a fixed member, the movable member being connected to the fixed member, and the movable member being movable relative to the fixed member.

4. A road marker placement apparatus according to claim 1, wherein the movable member is capable of being telescopically withdrawn into the fixed member, and is capable of being telescopically extended from the fixed member.

5. A road marker placement apparatus according to claim 1, wherein the dispenser comprises a container for containing a plurality of the road markers, wherein the container is configured to contain the plurality of the road markers in a stacked condition of the road markers.

6. A road marker placement apparatus according to claim 5, wherein the dispenser further includes a delivery arrangement for delivering the road markers individually to the carriage.

7. A road marker placement apparatus according to claim 6, wherein the delivery arrangement comprising a delivery member defining a recess in which one of the road markers can be received.

8. A road marker placement apparatus according to claim 6, wherein the delivery member is movable between a receiving position, in which the road marker can be received in the recess, and a delivery position in which the road marker can be delivered to the carriage.

9. A road marker placement apparatus according to claim 6, wherein the delivery arrangement further includes a force applying means for applying a force to the delivery member to move the delivery member between the receiving and delivery positions.

10. A road marker placement apparatus according to claim 1, wherein the road marker placement apparatus is mountable on a vehicle, and the road marker placement apparatus comprises a speed measuring arrangement to measure the speed of the vehicle, the speed measuring arrangement being connected to a control arrangement, so that information relating to the speed of the vehicle is processed by the control arrangement to control the movement of the dispenser, of the carriage and of the drive arrangement, and to control the operation of the placement arrangement.

11. A road marker placement apparatus according to claim 10, wherein the speed measuring arrangement comprises a road engaging wheel to engage the road, whereby the speed of rotation of the wheel allows the speed of the vehicle to be measured.

12. A road marker placement apparatus comprising: a dispenser for dispensing a road marker: a carriage for carrying the road marker dispensed by the dispenser; an elongate guide member; and a drive arrangement to drive the carriage along the guide member from a collecting position at which the carriage can collect the road marker from the dispenser; wherein the carriage includes: a placement arrangement for placing the road marker on the road, the placement arrangement comprising a movable member which can be moved between a withdrawn position and an extended placement position; and a holding device for holding the road marker, the holding device being provided on the movable member, whereby when the movable member is in the extended placement position, the holding device can release the road marker and place the road marker on the road while the carriage is driven by the drive arrangement, wherein the drive arrangement comprises a drive belt.

13. A road marker placement apparatus according to claim 12, wherein the carriage further includes a cooperating arrangement attached to the drive belt, the cooperating arrangement connecting the carriage to the drive belt, thereby allowing the carriage to be moved by the drive belt from the collecting position to place the road marker.

14. A road marker placement apparatus according to claim 13, wherein the drive arrangement further comprises a prime mover for driving the belt.

15. A road marker placement apparatus mountable on a vehicle movable in a first direction, the road marker placement apparatus comprising a dispenser for dispensing a road marker, a carriage for carrying the road marker dispensed by the dispenser, and a drive arrangement for driving the carriage from a collecting position, at which the carriage can collect the road marker from the dispenser, so that the carriage can place the road marker on the road while the carriage is driven by the drive arrangement in a second direction opposite to the first direction of movement of the vehicle wherein the carriage includes a placement arrangement for placing the road marker on the road, the placement arrangement comprising a movable member which can be moved between a withdrawn position and an extended placement position.

16. A road marker placement apparatus according to claim 15, including a holding device for holding the road marker, the holding device being provided on the movable member, whereby when the movable member is in the extended placement position, the holding device can release the road marker and place the road marker on the road while the carriage is driven by the drive arrangement.

17. A road marker placement apparatus according to claim 15, wherein the road marker placement apparatus comprises a speed measuring arrangement to measure the speed of the vehicle, the speed measuring arrangement being connected to a control arrangement, so that information relating to the speed of the vehicle is processed by the control arrangement to control the movement of the dispenser, of the carriage and of the drive arrangement, and to control the operation of the placement arrangement.

18. A road marker placement apparatus according to claim 17, wherein the speed measuring arrangement comprises a road engaging wheel to engage the road, whereby the speed of rotation of the wheel allows the speed of the vehicle to be measured.

19. A method of placing a road marker on a road, wherein the method comprises:

providing road marker placement apparatus mounted on a vehicle, the road marker placement apparatus comprising a dispenser and a carriage, the carriage including a placement arrangement for placing the road marker on the road, wherein the placement arrangement comprises a movable member, and the road marker placement apparatus further including an elongate guide member along which the carriage can be driven by a drive arrangement, wherein the method comprises:

moving the vehicle along the road at a predetermined speed;

dispensing a road marker from the dispenser;

collecting the road marker from the dispenser at a collecting position of the carriage;

driving the carriage along the guide member in the rearwards direction of the vehicle from the collecting position to a placing position of the carriage;

wherein the step of driving the carriage along the guide member comprises driving the carriage in the opposite direction to the direction of the vehicle at a speed that is equal to the speed of the vehicle, whereby the carriage remains above the same spot on the road while the carriage is so driven;

moving the movable member between a withdrawn position and an extended placement position;

disposing a discrete amount of an adhesive on the aforesaid spot on the road, and moving the movable member from the withdrawn position to the extended placement position to place the road marker and placing the road marker on the adhesive.

* * * * *